US011148105B2

(12) United States Patent
Nie et al.

(10) Patent No.: US 11,148,105 B2
(45) Date of Patent: Oct. 19, 2021

(54) MICROBUBBLE GENERATION DEVICE

(71) Applicant: JIANGSU LANSHAN ENVIRONMENT TECHNOLOGY CO., LTD., Nanjing (CN)

(72) Inventors: Jiangning Nie, Nanjing (CN); Yunqing Zhao, Nanjing (CN); Bin Ling, Nanjing (CN)

(73) Assignee: JIANGSU LANSHAN ENVIRONMENT TECHNOLOGY CO., Nanjing (CN)

( * ) Notice: Subject to any disclaimer, the term of this patent is extended or adjusted under 35 U.S.C. 154(b) by 258 days.

(21) Appl. No.: 16/317,825

(22) PCT Filed: Jul. 28, 2017

(86) PCT No.: PCT/CN2017/094847
§ 371 (c)(1),
(2) Date: Jan. 14, 2019

(87) PCT Pub. No.: WO2018/024159
PCT Pub. Date: Feb. 8, 2018

(65) Prior Publication Data

US 2019/0232236 A1 Aug. 1, 2019

(30) Foreign Application Priority Data

Aug. 1, 2016 (CN) ..... 201610617272.5

(51) Int. Cl.
*B01F 3/04* (2006.01)
*B01F 5/04* (2006.01)

(52) U.S. Cl.
CPC ..... *B01F 3/04262* (2013.01); *B01F 3/04* (2013.01); *B01F 5/04* (2013.01);
(Continued)

(58) Field of Classification Search
CPC .. B01F 2003/04319; B01F 2003/04361; B01F 2003/04858; B01F 2003/04177;
(Continued)

(56) References Cited

U.S. PATENT DOCUMENTS 3,351,292 A * 11/1967 Stuart, Sr. ..... B05B 1/323 239/533.13
5,525,242 A * 6/1996 Kerecz ..... C02F 1/72 210/758

(Continued)

FOREIGN PATENT DOCUMENTS

CN 2081753 7/1991
CN 101144545 3/2008

(Continued)

OTHER PUBLICATIONS

EPO translation of Katsutoshi et al. JPS586281 published Jan. 13, 1983 (Year: 1983).*

*Primary Examiner* — Stephen Hobson
(74) *Attorney, Agent, or Firm* — Treasure IP Group, LLC

(57) ABSTRACT

A microbubble generation device comprises a liquid inlet (101), a gas inlet (104), a bubble flow outlet (103), and a gas-liquid mixing chamber (102). An air-permeable hole having an angle structure is provided at a gas-liquid interface of the gas-liquid mixing chamber (102), and a pointed end of the angle structure of the air-permeable hole points to a liquid flow direction. The bubbles generated by the device are extremely small in diameter, prolonging a duration the bubbles stay in the liquid phase, and enhancing gas-liquid mass transfer efficiency.

10 Claims, 8 Drawing Sheets

(52) U.S. Cl.
CPC ..... *B01F 2003/04148* (2013.01); *B01F 2003/04177* (2013.01); *B01F 2003/04312* (2013.01); *B01F 2003/04319* (2013.01); *B01F 2003/04361* (2013.01); *B01F 2003/04858* (2013.01); *B01F 2215/0036* (2013.01)

(58) Field of Classification Search
CPC ..... B01F 3/04099; B01F 2003/04148; B01F 2003/04312; B01F 3/04262; B01F 3/04; B01F 5/04; B01F 2215/0036; B01F 2005/0446; B01F 5/0475; B01F 5/0473; B01F 3/0446; B01F 5/043; B01F 3/04446; B01F 3/04829; B01F 3/04836; B01F 5/0408; B01F 3/04063
See application file for complete search history.

(56) References Cited

U.S. PATENT DOCUMENTS 5,845,993 A * 12/1998 Shirtum ..... B01F 5/0682 366/348
9,144,774 B2 * 9/2015 Livshits ..... B01F 3/0446
9,981,229 B2 * 5/2018 Matsunaga ..... B05B 7/0425
10,801,003 B2 * 10/2020 Jaques ..... C12M 29/00
2009/0023189 A1 * 1/2009 Lau ..... B01F 13/0059 435/91.2
2009/0201761 A1 * 8/2009 Matsuno ..... B01F 5/0057 366/165.2
2011/0194995 A1 * 8/2011 Rigler ..... B01F 5/0471 422/504
2020/0122098 A1 * 4/2020 Chen ..... E21B 43/168

FOREIGN PATENT DOCUMENTS

| | | | |
|---|---|---|---|
| CN | 202199278 | | 4/2012 |
| CN | 103861488 | | 6/2014 |
| CN | 104772055 | | 7/2015 |
| CN | 106000070 | | 10/2016 |
| CN | 106076135 | | 11/2016 |
| CN | 205868041 | | 1/2017 |
| EP | 2067524 | | 6/2009 |
| GB | 694918 | * | 7/1953 |
| JP | S586281 B2 | * | 2/1983 |
| WO | 2008/144288 A1 | | 11/2008 |
| WO | 2010/022428 A1 | | 3/2010 |

* cited by examiner

MICROBUBBLE GENERATION DEVICE

CROSS REFERENCE TO RELATED APPLICATION

This application claims priority to a PCT application PCT/CN2017/094847, filed on Jul. 28, 2017, which in turn takes priority of Chinese Application No. 201610617272.5, filed on Aug. 1, 2016. Both the PCT application and Chinese Application are incorporated herein by reference in their entireties.

BACKGROUND

Technical Field

The present invention relates to the field of chemical engineering technologies, and specifically, to a microbubble generator.

Related Art

Sizes of bubbles discharged by an existing microbubble diffuser are about several millimeters to tens of millimeters, a total contact area of the bubbles and liquid is small, and the bubbles stay in water for a short time, causing low gas-liquid two-phase mass-transfer efficiency. An effective method for improving gas-liquid mass-transfer is to generate smaller bubbles. However, to generate micron level bubbles, an existing device has problems such as high energy consumption and a small volume of gas blowing.

SUMMARY OF THE INVENTION

For the problems in the prior art, the technical objective of the present invention is to provide a microbubble generator having lower energy consumption, a large volume of gas blowing, and a desirable gas-liquid mixing effect.

To achieve the foregoing technical objective, the technical solution disclosed in the present invention is:

a microbubble generator, provided with a liquid inlet, a gas inlet, a bubble flow outlet, and a gas-liquid mixing chamber, where a gas-liquid interface of the gas-liquid mixing chamber is provided with air holes having a angle structure, and a pointed end of the angle structure of the air hole points to the liquid flow direction.

On the basis of the foregoing solution, further improved or preferred solutions further include:

Solution 1: The air holes are disposed on a microbubble generation plate, the microbubble generator is provided with a microbubble generation plate mounting structure, the mounting structure includes a gas gathering chamber disposed in the gas-liquid mixing chamber, an inner chamber of the gas gathering chamber is in communication with the gas inlet, a wall surface of the gas gathering chamber that is in contact with liquid and that is parallel to the liquid flow direction is provided with at least one air window, and the microbubble generation plate is encapsulated at the air window.

Further, a cross section of the gas gathering chamber is U-shaped, a channel for the liquid to pass through is disposed symmetrically between two side walls of the gas gathering chamber and two side chamber walls of the gas-liquid mixing chamber, the channel and the liquid flow direction are in a same direction, and the air window is mounted on a wall surface of two sides of the gas gathering chamber.

Solution 2: A gas gathering chamber is disposed in the gas-liquid mixing chamber, the gas gathering chamber forms a ring inner chamber by using an inner-outer layer sleeve structure, the ring inner chamber is in communication with the gas inlet, the liquid passes through a tube chamber of an inner-layer tube of the sleeve structure, and the air holes are provided on a tube wall of the inner-layer tube.

The inner-layer tube of the inner-outer layer sleeve structure is coaxial with or partially fits an outer-layer tube.

Solution 3: The gas-liquid mixing chamber is formed by a liquid pipeline and an air intake tube chamber attached to an outside of the liquid pipeline, the air intake tube chamber is connected to the gas inlet, the gas-liquid interface is an attachment surface on which the air intake tube chamber is connected to the liquid pipeline, and the air holes are disposed on the attachment surface.

In the foregoing solutions:

on two sides of the gas-liquid interface, the gas flow direction is perpendicular to the liquid flow direction.

A nozzle edge of the bubble flow outlet is provided with a zigzag incision, so that large bubbles gathered by microbubbles in flow may be dispersed again, to ensure a gas-liquid mixing effect.

When the bubble flow outlet is horizontally disposed, a flat nozzle enlarging in a width direction and shrinking in a height direction is used. The zigzag incision is preferably disposed on an upper edge of the flat nozzle.

When the nozzle of the bubble flow outlet is upward, a multilayer concentric and coaxial conical baffle ring is disposed in the nozzle, an outlet edge of the conical baffle ring is also provided with a zigzag incision, an overflowing gap is remained between neighboring inner and outer baffle rings, and a projection of the outer baffle ring in an axial direction blocks the overflowing gap.

When the nozzle of the bubble flow outlet is downward, a conical nozzle having a diameter shrinking along the liquid flow direction is used for the bubble flow outlet.

Beneficial Effects:

When a gas is blown into liquid in the microbubble generator of the present invention, because a liquid on one side of the gas-liquid interface flows quickly, a gas passing through the air hole is cut into microbubbles at the pointed end of the angle structure of the air hole. Because an equivalent diameter of a gas channel at the pointed end of the angle structure tends to be infinitely small along the liquid flow direction, the generated bubbles have extremely small diameters, and stay in a liquid phase for a longer time, and gas-liquid mass-transfer efficiency is obviously improved. After the zigzag structure is disposed on the bubble flow outlet, large bubbles gathered by microbubbles in flow may be dispersed again, to ensure a gas-liquid mixing effect, and the microbubble generator of the present invention has advantages of lower energy consumption, a large volume of gas blowing, and a desirable gas-liquid mixing effect.

DETAILED DESCRIPTION

Figure 1:
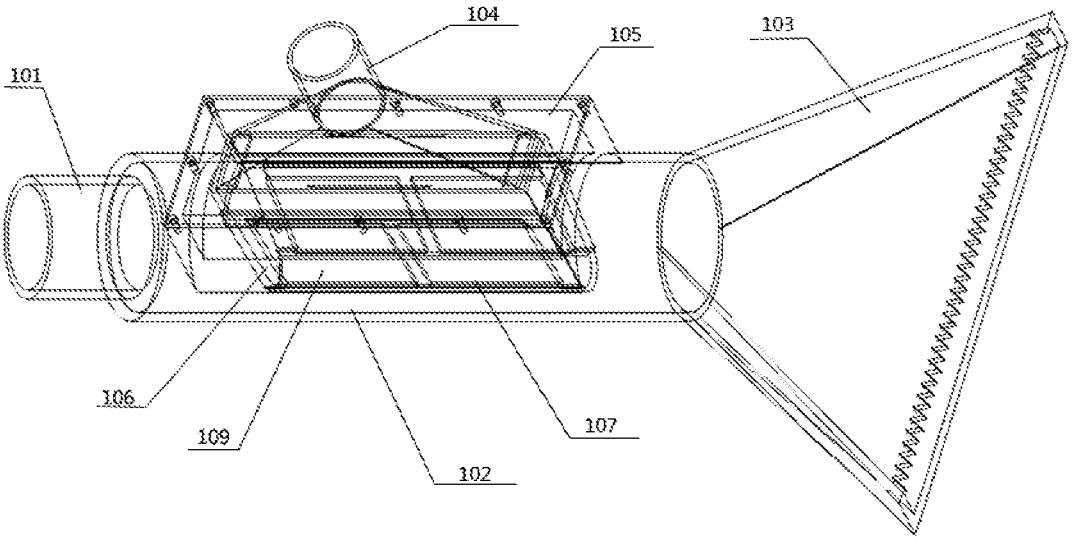
FIG. 1 is a schematic diagram of a three-dimensional structure of Embodiment 1.
Figure 2:
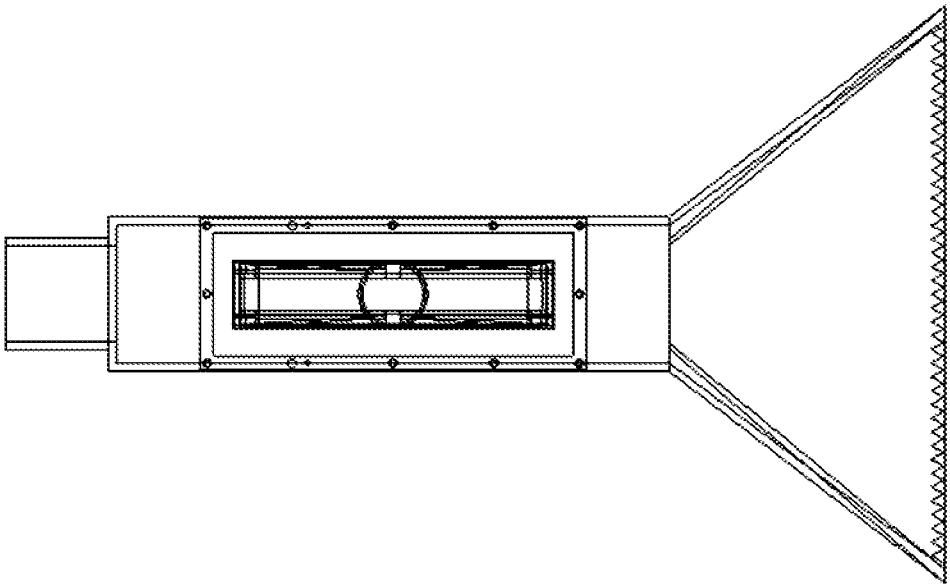
FIG. 2 is a schematic diagram of a top structure of Embodiment 1.
Figure 3:
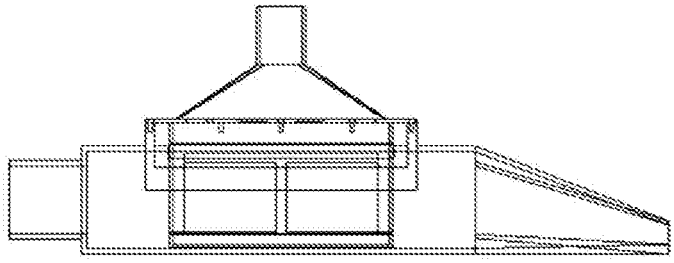
FIG. 3 is a schematic diagram of a front structure of Embodiment 1.
Figure 4:
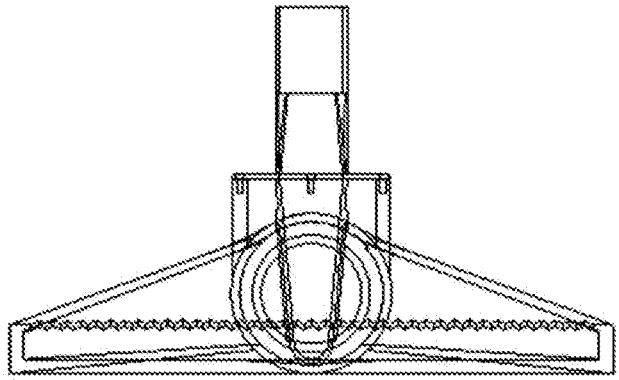
FIG. 4 is a schematic diagram of a side structure of Embodiment 1.
Figure 5:
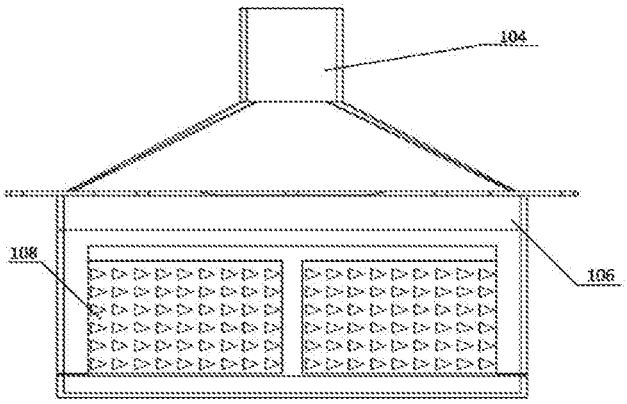
FIG. 5 is a schematic diagram of a microbubble generation plate mounting structure.

To further describe the technical solution and technical objective of the present invention, the following further describes the present invention with reference to the accompanying drawings and specific embodiments.

Embodiment 1

As shown in FIG. 1 to FIG. 5, a microbubble generator is provided with a liquid inlet 101, a gas inlet 104, a bubble flow outlet 103, a gas-liquid mixing chamber 102, a microbubble generation plate 108, and a microbubble generation plate mounting structure 106. The microbubble generation plate 108 is provided with an array formed by a plurality of regularly arranged air holes, the air hole is in a shape having a angle structure, such as a rectangle, a triangle, a rhombus, or a drop shape, and a pointed end of the angle structure points to the liquid flow direction. An air intake direction of the gas inlet 104 is perpendicular to the liquid flow direction.

The microbubble generation plate mounting structure 106 includes a gas gathering chamber 109 disposed in the gas-liquid mixing chamber 102, a cross section of an inner chamber of the gas gathering chamber 109 is U-shaped, an upper opening of the gas gathering chamber 109 is in communication with the gas inlet 104, front and back ends of the gas gathering chamber 106 are provided with a baffle plate, a channel for liquid to pass through is symmetrically disposed between two side walls of the gas gathering chamber 106 and two side chamber walls of the gas-liquid mixing chamber, and the channel is in a same direction with the liquid flow direction. The two side walls of the gas gathering chamber 109 are respectively provided with two air windows 107, and the microbubble generation plate 108 is encapsulated in the air window 107. A rectangular plate mounting seat is disposed above an upper opening of the gas-liquid mixing chamber 102, the microbubble generation plate mounting structure 106 includes a rectangular cover plate 105 that covers the opening of the gas gathering chamber and the opening of the gas-liquid mixing chamber. The cover plate 105 is fixed on the rectangular plate mounting seat by using a screw, and an air intake pipe provided with the gas inlet 104 is connected to the cover plate 105.

When the bubble flow outlet 103 is horizontally disposed, a flat nozzle enlarging in a width direction and shrinking in a height direction is used. A zigzag incision is disposed on an upper edge of the flat nozzle.

In this embodiment, the microbubble generation plate may also be replaced with a suitable weaving material having air holes.

Embodiment 2

Figure 6:
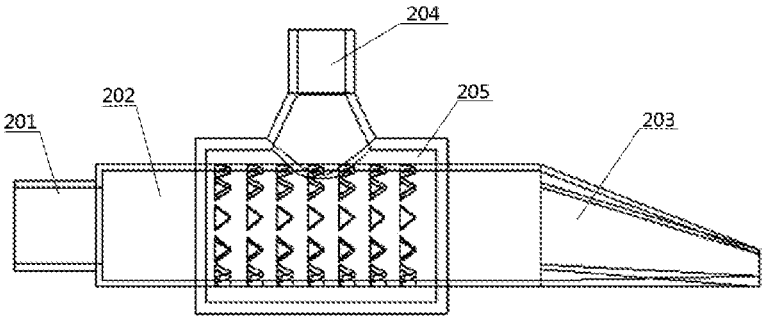
FIG. 6 is a schematic diagram of a front structure of Embodiment 2.
Figure 7:
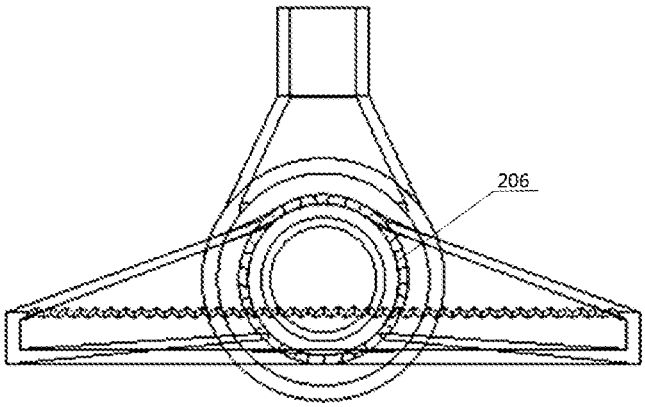
FIG. 7 is a schematic diagram of a side structure of Embodiment 2.
Figure 8:
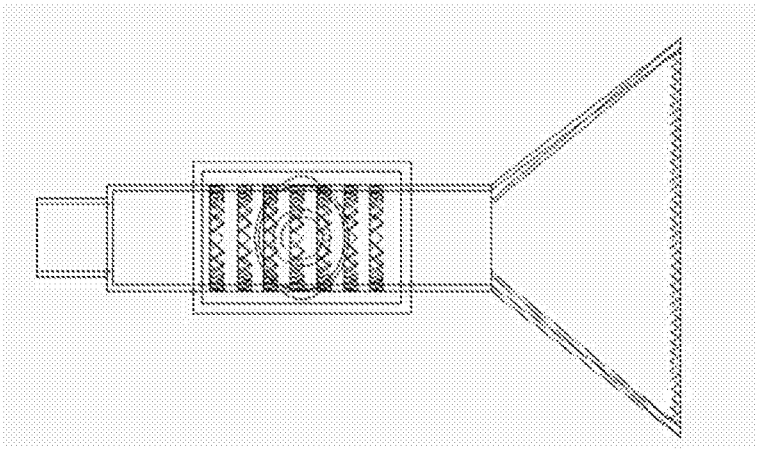
FIG. 8 is a schematic diagram of a top structure of Embodiment 2.

As shown in FIG. 6 to FIG. 8, a microbubble generator is provided with a liquid inlet 201, a gas inlet 204, a bubble flow outlet 203, and a gas-liquid mixing chamber 202. An air intake direction of the gas inlet 204 is perpendicular to the liquid flow direction.

A gas gathering chamber 205 is disposed in the gas-liquid mixing chamber, the gas gathering chamber 205 forms a ring inner chamber by using a coaxial inner-outer layer sleeve structure, the ring inner chamber is in communication with the gas inlet 204, liquid passes through a tube chamber of an inner-layer tube 206 of the sleeve structure, and a tube wall of the inner-layer tube 206 is provided with an air hole array formed by regularly arranged air holes.

The air hole is also in a shape having a angle structure, such as a triangle, a rhombus, or a drop shape, and a pointed end of the angle structure points to the liquid flow direction.

A same design solution is used for the bubble flow outlet 203 and the bubble flow outlet 103 in Embodiment 1.

Embodiment 3

Figure 9:
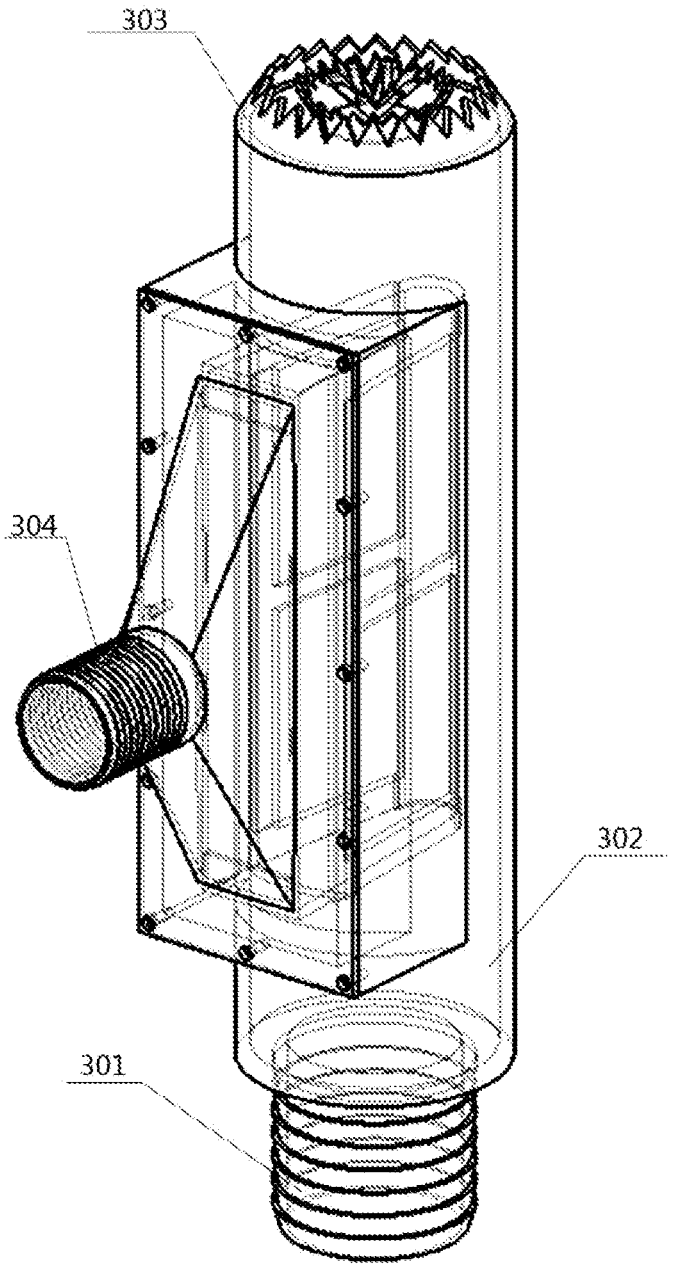
FIG. 9 is a schematic diagram of a three-dimensional structure of Embodiment 3.
Figure 10:
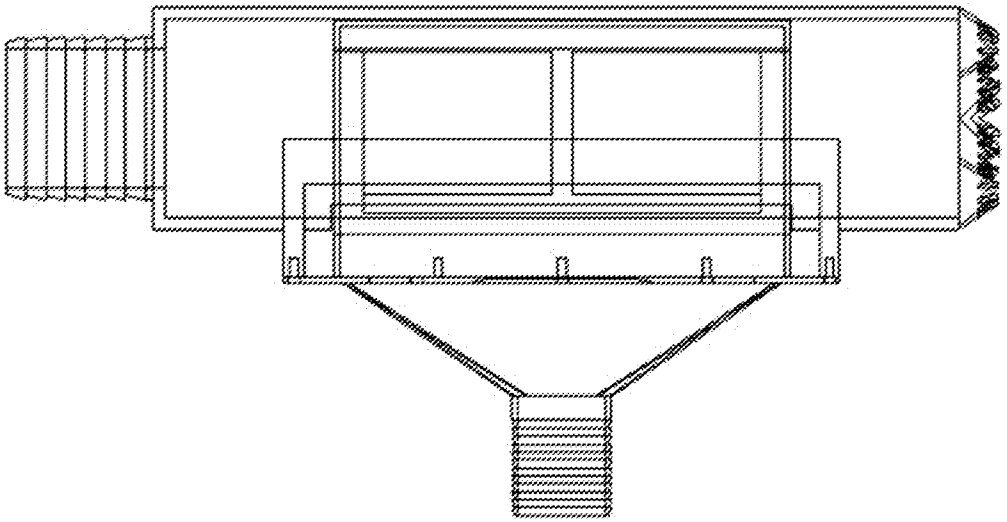
FIG. 10 is a schematic diagram of a front structure of Embodiment 3.

As shown in FIG. 9 and FIG. 10, a microbubble generator shares a same main structure as in Embodiment 1, and is provided with a liquid inlet 301, a gas inlet 304, a bubble flow outlet 303, a gas-liquid mixing chamber 302, a microbubble generation plate, a microbubble generation plate mounting structure, and other components.

A difference from Embodiment 1 lies in: A nozzle of the liquid inlet 301 is downward, and a nozzle of the bubble flow outlet 303 is upward. The bubble flow outlet 303 is a conical nozzle having a diameter decreasing, a nozzle edge of the bubble flow outlet 303 is provided with a zigzag incision, the nozzle of the bubble flow outlet 303 is further provided with a multilayer conical baffle ring concentric and coaxial with the bubble flow outlet 303, an outlet edge of the baffle ring is also provided with a zigzag incision, an overflowing gap is remained between neighboring inner and outer baffle rings, a diameter of the conical baffle ring decreases along the liquid flow direction, and a projection of the outer baffle ring in an axial direction blocks the overflowing gap.

Embodiment 4

Figure 11:
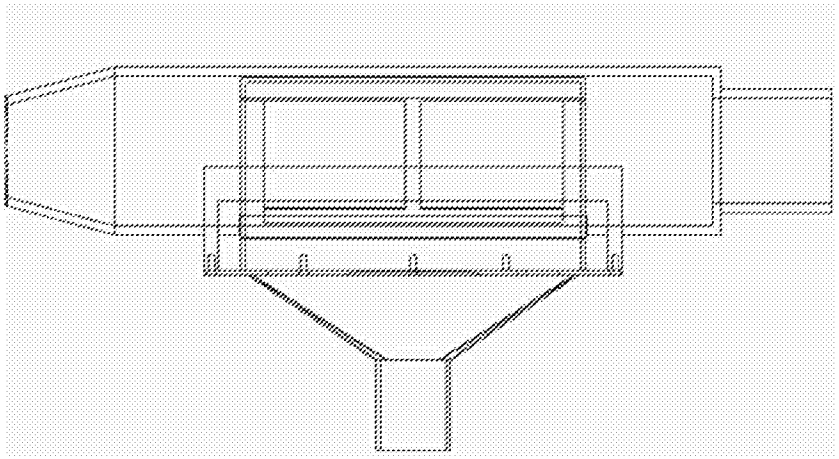
FIG. 11 is a schematic diagram of a front structure of Embodiment 4.

As shown in FIG. 11, the design solution is the same as that in Embodiment 3, and a difference lies in: A nozzle of the liquid inlet is upward, and a nozzle of the bubble flow outlet is downward, but no conical baffle ring is disposed.

Embodiment 5

Figure 12:
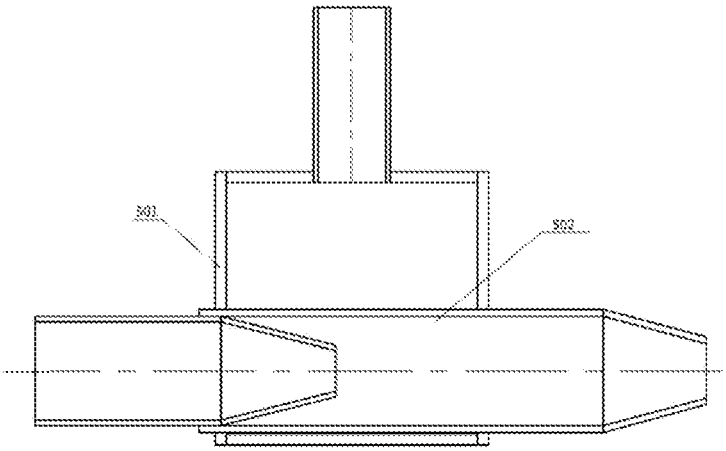
FIG. 12 is a schematic diagram of a front structure of Embodiment 5.
Figure 13:
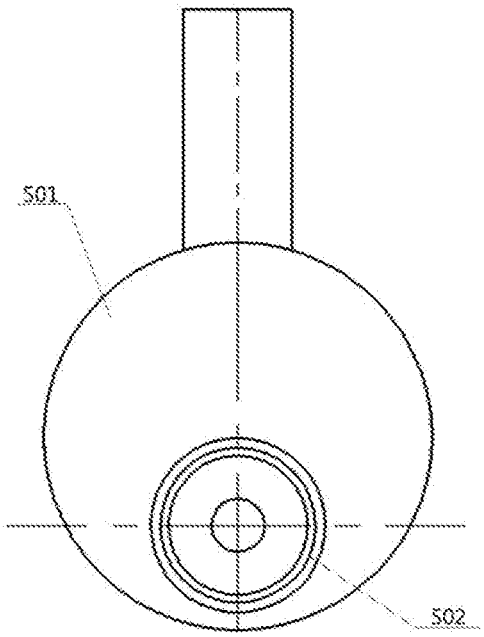
FIG. 13 is a schematic diagram of a side structure of Embodiment 5.

On the basis of Embodiment 2, the inner-outer layer sleeve structure is changed to a bottom fitting form. As shown in FIG. 12 and FIG. 13, an inner-layer tube 502 and an outer-layer tube 501 are fitted at the bottom, and the inner-layer tube 502 entirely or the tube wall on the top are evenly distributed with air holes.

Embodiment 6

Figure 14:
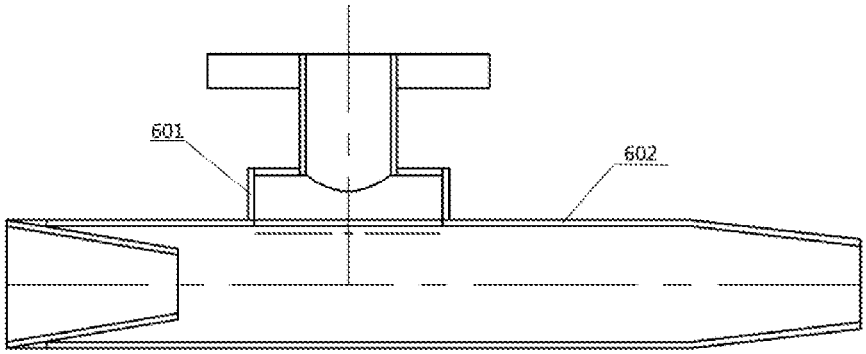
FIG. 14 is a schematic diagram of a front structure of Embodiment 6.
Figure 15:
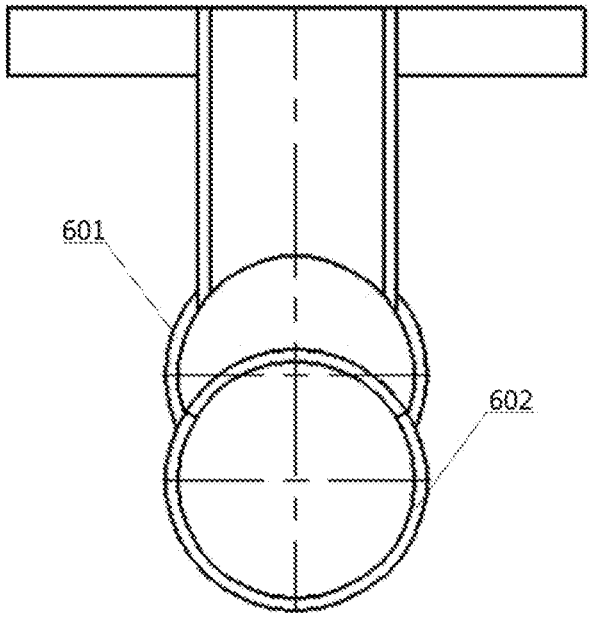
FIG. 15 is a schematic diagram of a side structure of Embodiment 6.

As shown in FIG. 13 and FIG. 14, a microbubble generator is provided with a liquid inlet 604, a gas inlet 603, a bubble flow outlet, and a gas-liquid mixing chamber.

The gas-liquid mixing chamber is formed by a liquid pipeline 602 and an air intake tube chamber 601 attached on an outside of the liquid pipeline 602, the air intake tube chamber 601 is connected to the gas inlet 603, the gas-liquid interface is an attachment surface on which the air intake tube chamber 601 is connected to the liquid pipeline 602, the attachment surface is provided with air holes having a angle structure, and a pointed end of the angle structure points to the liquid flow direction.

A tube body, such as an inner-outer layer sleeve structure, a liquid pipeline, or an air intake tube chamber in the foregoing embodiments, is generally a circular tube, or may be another tube shape, such as a square tube. Diameters of microbubbles generated by the microbubble generator of the present invention are several microns to tens of microns, and the microbubble generator can be widely applied to fields such as industries and environmental protection. The foregoing displays and describes the basic principle, main features, and advantages of the present invention. A person skilled in the art should understand that the present invention is not limited by the foregoing embodiments, and the foregoing embodiments and descriptions in the specification are only for describing the principle of the present invention. Variations and improvements may be made to the present invention without departing from the spirit and scope of the present invention, and the protection scope required by the present invention is defined by the claims, specification, and equivalents thereof.

What is claimed is:

1. A microbubble generation device, provided with a liquid inlet, a gas inlet, a bubble flow outlet, and a gas-liquid mixing chamber, wherein a gas-liquid interface of the gas-liquid mixing chamber is provided with air holes having an angle structure, and a pointed end of the angle structure points to a liquid flow direction, wherein the air holes are disposed on a microbubble generation plate, the microbubble generation device is provided with a microbubble generation plate mounting structure, the mounting structure comprises one or more gas gathering chambers disposed in the gas-liquid mixing chamber, an inner chamber of the one or more gas gathering chambers is in communication with the gas inlet, a wall surface of the one or more gas gathering chambers that is in contact with liquid and that is parallel to the liquid flow direction is provided with at least one air window, and the microbubble generation plate is encapsulated at the at least one air window.

2. The microbubble generation device according to claim 1, wherein a cross section of the one or more gas gathering chambers is U-shaped, a channel for the liquid to pass through is disposed between two side walls of the one or more gas gathering chambers and two side chamber walls of the gas-liquid mixing chamber, the channel and the liquid flow direction are in a same direction, and the at least one air window is mounted on a wall surface of two sides of the one or more gas gathering chambers.

3. The microbubble generation device according to claim 1, wherein the one or more gas gathering chambers is disposed in the gas-liquid mixing chamber, the one or more gas gathering chambers forms a ring inner chamber by using an inner-outer layer sleeve structure, the ring inner chamber is in communication with the gas inlet, the liquid passes through a tube chamber of an inner-layer tube of the sleeve structure, and the air holes are provided on a tube wall of the inner-layer tube.

4. The microbubble generation device according to claim 3, wherein the inner-layer tube of the inner-outer layer sleeve structure is coaxial with or partially fits an outer-layer tube.

5. The microbubble generation device according to claim 1, wherein the gas-liquid mixing chamber is formed by a liquid pipeline and an air intake tube chamber attached to an outside of the liquid pipeline, the air intake tube chamber is connected to the gas inlet, the gas-liquid interface is an attachment surface on which the air intake tube chamber is connected to the liquid pipeline, and the air holes are disposed on the attachment surface.

6. The microbubble generation device according to claim 1, wherein on two sides of the gas-liquid interface, the gas flow direction is perpendicular to the liquid flow direction.

7. The microbubble generation device according to claim 1, wherein a nozzle edge of the bubble flow outlet is provided with a zigzag incision.

8. The microbubble generation device according to claim 7, wherein when the bubble flow outlet is horizontally disposed, a flat nozzle enlarging in a width direction and shrinking in a height direction is used.

9. The microbubble generation device according to claim 7, wherein when the nozzle of the bubble flow outlet is upward, a multilayer concentric and coaxial conical baffle ring is disposed in the nozzle, an outlet edge of the conical baffle ring is also provided with a zigzag incision, an overflowing gap is remained between neighboring inner and outer baffle rings, and a projection of the outer baffle ring in an axial direction blocks the overflowing gap.

10. The microbubble generation device according to claim 7, wherein when the nozzle of the bubble flow outlet is downward, a conical nozzle having a diameter shrinking along the liquid flow direction is used for the bubble flow outlet.

* * * * *